United States Patent [19]

Travinski

[11] 4,360,351

[45] Nov. 23, 1982

[54] INFLATABLE SAFETY BELT

[76] Inventor: A. Robert Travinski, 6801 NE. 137th St., Vancouver, Wash. 98665

[21] Appl. No.: 84,177

[22] Filed: Oct. 12, 1979

[51] Int. Cl.[3] ..... B63C 9/16

[52] U.S. Cl. ..... 441/94; 441/108

[58] Field of Search ..... 9/340, 341, 342, 343, 9/344, 345, 346, 316, 311, 312, 319, 329, 337

[56] References Cited

U.S. PATENT DOCUMENTS

| | | | |
|---|---|---|---|
| 1,870,535 | 8/1932 | Stellmacher | 9/340 X |
| 2,165,300 | 7/1939 | Peterson | 9/316 |
| 2,463,641 | 3/1949 | Podell | 9/343 |
| 2,703,891 | 3/1955 | Mayer | 9/340 X |
| 2,869,151 | 1/1959 | Johnson | 9/340 X |
| 4,097,947 | 7/1978 | Kiefer | 9/342 X |
| 4,176,772 | 12/1979 | Danon | 9/340 X |

FOREIGN PATENT DOCUMENTS

| | | | |
|---|---|---|---|
| 610630 | 10/1960 | Italy | 9/316 |

*Primary Examiner*—Trygve M. Blix
*Assistant Examiner*—Harry A. Smith
*Attorney, Agent, or Firm*—Eugene M. Eckelman

[57] ABSTRACT

A strip-like body member in the form of a belt has one or more slits extending through it. A flat air-tight expandable bladder extends along the rear surface of the body member and is enclosed between such body member and a backing strip. A pocket is provided on the body member for removably holding a gas cartridge, and such cartridge is associated with an actuator arranged to release the contents of the cartridge. The cartridge communicates with the bladder and when opened by a pull line connected to the actuator, the bladder expands forwardly through the slits to form a buoyant life preserver. The body member is dimensioned and arranged to be passed through the conventional trouser belt loops so as to serve the dual purpose of holding up trousers and to be available as a life preserver when needed. The pull line is held normally in place by a releasable hold-down connector so as to be out of the way until needed. The body member has a transverse loop arranged to hold an opposite overlapping end portion thereof to protect the inflating apparatus.

1 Claim, 5 Drawing Figures

INFLATABLE SAFETY BELT

BACKGROUND OF THE INVENTION

This invention relates to new and useful improvements in inflatable safety belts.

Inflatable safety belts have heretofore been provided which are arranged to be mounted around the waist and which are arranged to be inflated by a gas cartridge when needed. One disadvantage of some of these prior devices is that their sole function is to act as a life preserver, whereby they are connected to the person, as by fastening them around the waist, only during those times that it is thought they are needed. Thus, the use of such prior life preservers is under the indefinite control of the person wearing them or other persons who may be in charge. Since they require extra work in installing them, there may be situations where the person needing a life preserver may neglect to put it on or plainly does not want to put it on.

Some of the prior inflatable safety belts also have the disadvantage that they are cumbersome and expensive in structure and thus frequently get in the way of persons who must be active during the time that the belt should be worn.

SUMMARY OF THE INVENTION

According to the present invention and forming a primary objective thereof, an inflatable safety belt is provided which overcomes certain deficiencies in prior devices. A more particular object of the invention is to provide an inflatable safety belt which is compact in structure and arranged to be worn in the conventional belt loops of trousers so as to serve the dual purpose of holding up trousers and to be available as a life preserver when needed, and thus always being in place ready for use.

In providing such compact inflatable safety belt, there is employed a strip-like body member with releasable fastening means on the ends for securing it around the waist of a person, such body member being dimensioned and arranged to fit in the conventional belt loops. An airtight expandable bladder is provided on the rear side of the body member and is associated with controllable inflating means operable by the wearer. The body member has slit means through which the expandable bladder projects when inflated to form buoyant portions. A backing strip is secured to the body member on the rear side of the bladder to form an enclosing pocket therefor. A pull line is connected to the movable actuating means and is associated with releasable hold-down means which hold such line out of the way until needed. Transverse loop means is provided on the body member in the area of the inflating means so as to hold an opposite overlapping end portion of the body member over the inflating means to protect it.

The invention will be better understood and additional objects and advantages will become apparent from the following description taken in connection with the accompanying drawings.

DETAILED DESCRIPTION OF A PREFERRED EMBODIMENT

Figure 5:
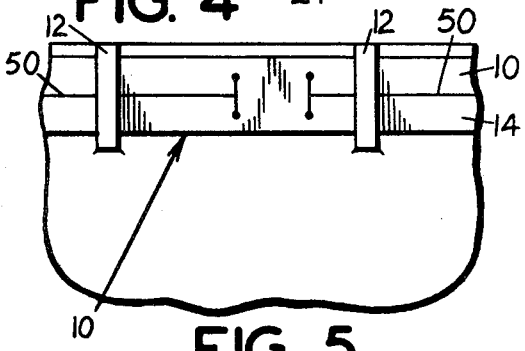
FIG. 5 is a fragmentary elevational view showing the belt as worn on the trousers.

With particular reference to the drawings, the inflatable safety belt of the invention is designated generally by the numeral 10, and important to the invention, the belt in its overall structure is arranged to serve as a normal belt wherein to be worn by a person through the conventional loops 12 of trousers as seen in FIG. 5 so that not only does the belt normally hold the trousers up but it is also available when needed as a life preserver.

The belt comprises a main body member 14 which may consist of a conventional leather belt having a buckle 16 on one end and an apertured portion 18 on the other end arranged for engagement with the buckle 16 and also arranged as a feature of the invention to extend considerably beyond the buckle and extend under a loop 20 whereby to provide protection for inflating means to be described.

A flat air-tight expandable bladder or envelope 22 extends along a greater portion of the rear surface of the body member 14 and is confined in a pocket provided by a backing strip or rear wall 24 which is secured around its longitudinal edges to the body member 14 by stitching 26 or other fastening means. Backing strip 24 is formed of a substantially non-stretchable material such as leather. Bladder 22 can be secured at its ends if desired by rivets 28 extending through it and backing strip 24.

Figure 1:
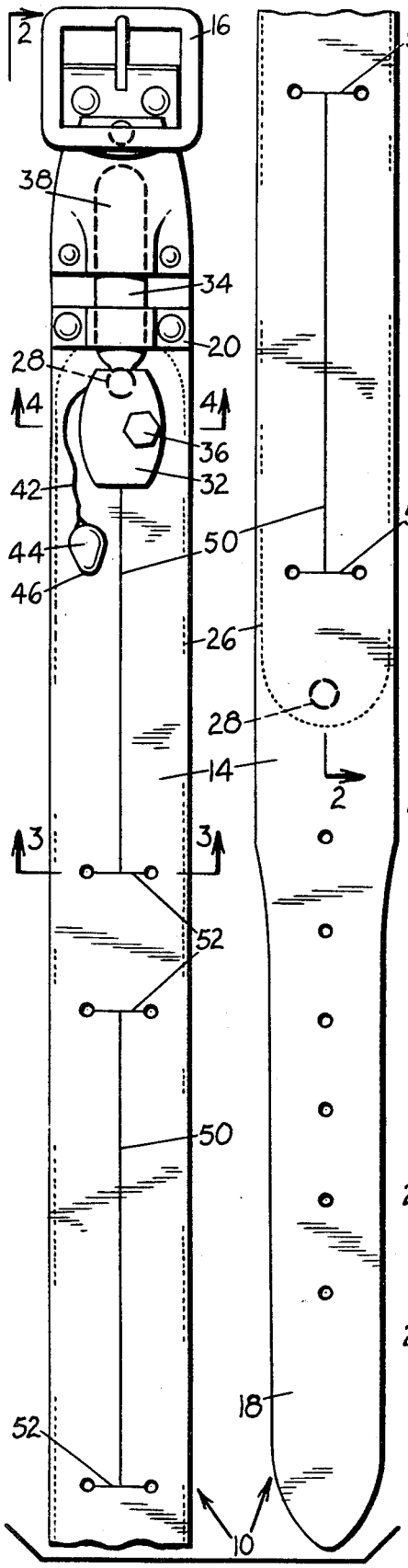
FIG. 1 is a composite elevational view of the present inflatable safety belt.
Figure 2:
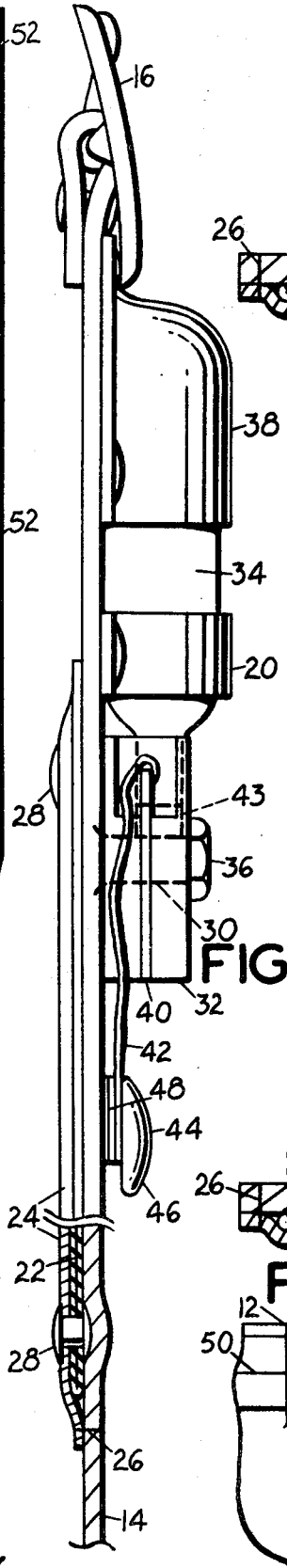
FIG. 2 is a view of such belt taken partly in elevation and partly in section on the line 2—2 of FIG. 1.
Figure 4:
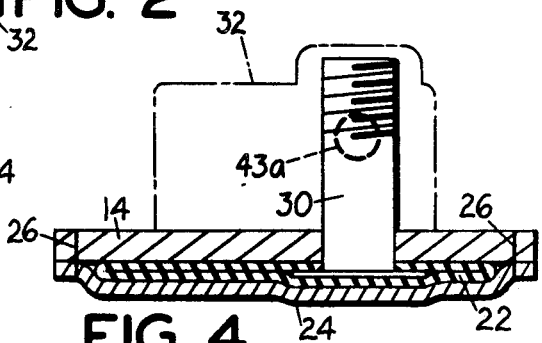
FIG. 4 is an enlarged cross sectional view of the belt taken on the line 4—4 of FIG. 1.

The end of the bladder 22 at the buckle end of the body member 14 has an outlet stem 30, FIGS. 2 and 4, associated with an actuator 32 which removably receives the neck end of a gas cartridge 34 such as a conventional $CO_2$ cartridge. Actuator 32 is secured in place by a hold-down nut 36 on the stem 30, and the cartridge 34 has the base or rearward portion thereof removably fitted into a pocket 38 formed on the body member with an open end facing the actuator 32. The loop 20 is sufficiently large to receive the cartridge 34 thereunder and also to receive end portion 18 of the body member.

Actuator 32 is of conventional construction, utilizing a movable member 40, such as a pivotal lever, which is arranged when pulled to puncture the opening into the gas cartridge. Such actuator means is of well known construction and may for example operate similar to that shown in U.S. Pat. No. 3,263,249 wherein a piercing pin operated by a lever is driven into the cartridge to release the pressurized gas for movement of the latter from a passageway 43 in the actuator, FIG. 2, to a port **43*a* in the stem 30. As a feature of the invention, applicant connects a pull line 42, such as a flexible cable, chain or the like, to the lever 40, and such pull line has an end tab 44 with a finger engaging end 46 which is readily grasped. The tab has a snap connection 48 with the body member 14 for fast release. Such snap connection holds the line 42 in an out of the way position but such line is readily made available by pulling on the finger extension 46**.

Body member 14 has at least one longitudinal slit 50 therein which allows the expandable bladder to project outwardly into a buoyant condition when the inflating means is actuated. Preferably, a plurality of such slits 50 in spaced relation start from a point adjacent the actuator and extend substantially around the body member. The ends of such longitudinal slits as well as an intermediate portion thereof have intersecting transverse slits 52, such arrangement of slits providing easy projection of portions of the expandable envelope in the inflated condition.

Figure 3:
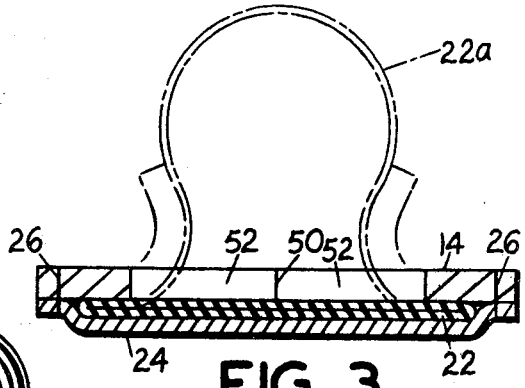
FIG. 3 is an enlarged sectional view of such belt taken on the line 3—3 of FIG. 1 and showing an expanded condition of the bladder in broken lines.

In operation, the wearer simply installs the belt on his trousers in the same manner as any other belt, and since the belt is used to hold up his trousers, such person or his employer can reasonably be assured that the life preserver is always in place ready for inflation and use. To inflate the life preserver, the wearer unsnaps the finger engaging end 44 of the pull line 42 and pulls on such line. This action causes the actuator to open the gas cartridge and inflate the bladder 22. The inflating pressure in the bladder causes portions thereof to open the slitted parts of the body member 14 and to project outwardly as seen in broken lines 22*a* in FIG. 3, thus forming the necessary buoyancy to hold a person up in the water. The bladder is deflated after its emergency use has terminated by removing nut 36 from stem 30. The belt can then be fitted with another charged gas cartridge.

The construction of the present inflatable safety belt is encouraged in its use since it is simplified and inexpensive to manufacture. That is, in view of such simplified structure persons will use it as a regular belt and will more likely have it in place than devices that have to be strapped to the body when the situation calls for it. Thus, in the event of an emergency, the life preserver function thereof will most likely always be available.

It is to be understood that the form of my invention herein shown and described is to be taken as a preferred example of the sample and that various changes in the shape, size and arrangement of parts may be resorted to without departing from the spirit of my invention, or the scope of the subjoined claims.

Having thus described my invention, I claim:

1. An inflatable safety belt comprising (a) a strip-like body member arranged to extend around the waist of a person, (b) said body member having opposite ends and front and rear surfaces, (c) releasable fastening means on said ends for releasably securing said body member around the waist of a person, (d) one or more slit means extending through the front surface of said body member, (e) said slit means comprising a plurality of spaced longitudinal slits and transverse slits intersecting said longitudinal slits, (f) a single flat air-tight expandable bladder extending along the rear surface of said body member in the area substantially between the fastening means at the ends, (g) means securing said bladder at its ends to said body member, (h) controllable inflating means on said body member operatively associated with said bladder and arranged when actuated to inflate said envelope, (i) said bladder, upon being inflated, expanding forwardly through said slit means to form a buoyant life preserver, (j) and a transverse loop on said body member in the area of said inflating means arranged to hold an opposite overlapping end portion of said body member over said inflating means to protect it.

* * * * *